US011634899B2

(12) United States Patent
Salazar

(10) Patent No.: US 11,634,899 B2
(45) Date of Patent: Apr. 25, 2023

(54) TOILET AND BATHROOM EXHAUST SYSTEM

(71) Applicant: Ervin E. Salazar, Pawtucket, RI (US)

(72) Inventor: Ervin E. Salazar, Pawtucket, RI (US)

( * ) Notice: Subject to any disclaimer, the term of this patent is extended or adjusted under 35 U.S.C. 154(b) by 0 days.

(21) Appl. No.: 17/090,015

(22) Filed: Nov. 5, 2020

(65) Prior Publication Data

US 2021/0140161 A1 May 13, 2021

Related U.S. Application Data

(60) Provisional application No. 62/943,509, filed on Dec. 4, 2019, provisional application No. 62/931,861, filed on Nov. 7, 2019.

(51) Int. Cl.
*E03D 9/052* (2006.01)
*A47K 13/30* (2006.01)

(52) U.S. Cl.
CPC ..... *E03D 9/052* (2013.01); *A47K 13/307* (2013.01)

(58) Field of Classification Search
CPC ..... A47K 13/307; E03D 9/04–052
See application file for complete search history.

(56) References Cited

U.S. PATENT DOCUMENTS 2,297,035 A * 9/1942 Svec ..... E03D 9/052 4/213
5,029,346 A * 7/1991 Fernald, Sr. ..... E03D 9/052 4/348
5,255,395 A * 10/1993 Millette ..... E03D 9/05 4/216
6,637,040 B1 * 10/2003 Alba ..... A47K 13/307 4/217
6,760,928 B1 * 7/2004 Rodriguez ..... E03D 9/052 4/217
6,772,449 B1 * 8/2004 Wolfe ..... E03D 9/05 4/213

(Continued)

FOREIGN PATENT DOCUMENTS

CN 203252577 U 10/2013
KR 200251116 Y1 11/2001

(Continued)

OTHER PUBLICATIONS

"Fresh Air Plus: The Odor Eliminating Toilet Seat", Adam Payz, Oct. 24, 2019.

(Continued)

*Primary Examiner* — David P Angwin
*Assistant Examiner* — Nicholas A Ros
(74) *Attorney, Agent, or Firm* — David R. Josephs; Hinckley, Allen & Snyder, LLP

(57) ABSTRACT

A toilet and bathroom exhaust system of the present invention provides a single system that handles both the removal of noxious air in an around the toilet and dehumidification of the air in the entire room. An intake manifold may be configured to be 1) attached to the bottom of the toilet lid; 2) attached to the top of the toilet rim; or 3) integrated into the toilet rim with the water drainage supply lines for flushing. The noxious air can be routed via an exhaust fan outside the house. The exhaust fan may also be configured to route noxious air into the trap area in the toilet. Proximity and humidity sensors may be used for further control and automation of the system.

8 Claims, 10 Drawing Sheets

(56) References Cited

U.S. PATENT DOCUMENTS

| | | | | |
|---|---|---|---|---|
| 8,060,952 | B2 | 11/2011 | Shaul | |
| 8,422,703 | B2 * | 4/2013 | Weigold | H04R 19/005 381/174 |
| 9,399,862 | B2 * | 7/2016 | Gallardo Chaparro | E03D 9/05 |
| 9,422,703 | B1 * | 8/2016 | Ciotic | E03D 9/052 |
| 9,745,732 | B2 * | 8/2017 | Suggs | E03D 9/052 |
| 2005/0138720 | A1 * | 6/2005 | Shim | E03D 9/052 4/213 |
| 2006/0021120 | A1 | 2/2006 | Nickle | |
| 2006/0096013 | A1 * | 5/2006 | Dang | E03D 9/05 4/213 |
| 2009/0235442 | A1 * | 9/2009 | Lee | E03D 9/052 4/217 |
| 2010/0043128 | A1 * | 2/2010 | Soldera | E03D 9/052 4/213 |
| 2012/0227170 | A1 | 9/2012 | Ineson et al. | |
| 2015/0292189 | A1 * | 10/2015 | Chavez | E03D 9/052 4/213 |
| 2017/0152655 | A1 | 6/2017 | Abunameh et al. | |

FOREIGN PATENT DOCUMENTS

| | | | |
|---|---|---|---|
| KR | 20090012112 | U | 11/2009 |
| WO | 200463480 | A2 | 7/2004 |

OTHER PUBLICATIONS

"Toilet seat with built-in fan sucks out the stench", Amanda Kooser, Sep. 2, 2014.

* cited by examiner

TOILET AND BATHROOM EXHAUST SYSTEM

CROSS REFERENCE TO RELATED APPLICATION

This application claims priority to earlier filed U.S. Provisional Patent Application No. 62/931,861, filed on Nov. 7, 2019, and U.S. Provisional Patent Application 62/943,509, filed on Dec. 4, 2019, the entire contents of both of which are incorporated herein by reference.

BACKGROUND OF THE INVENTION

The present disclosure relates generally to ventilation of toilets, and more particularly, but not necessarily entirely, to ventilation apparatuses attachable to or incorporated into toilets for removing noxious odors in the air in the immediate proximity of a toilet.

Conventional systems for ventilating noxious odors from bathrooms and other rooms commonly include a ceiling mounted fan typically controlled by a wall-mounted switch. Deodorizers can also be used to cover up the offending odors. Disadvantageously, both ceiling fans and deodorizers are not completely effective in removing the odors. In particular, ceiling fans are effective only after the odors have dissipated throughout the entire room, such as a bathroom. However, once this occurs, most ceiling fans cannot then effectively evacuate the bathroom of the odor. Deodorizers, on the other hand, do not evacuate the odors at all, but attempt to mask the odor. In the case of both ceiling fans and deodorizers, unpleasant residual odors and noxious air often remains, thereby causing embarrassment and discomfort to users of the bathroom.

Further, rooms can also suffer from excessive humidity levels, which can lead to mold thereby causing health problems with the occupants and degradation of the home. Therefore, there is also a need for a toilet and bathroom exhaust system that can effectively remove humidity as well.

In the past, numerous attempts have been made to overcome the drawbacks associated with ceiling mounted fans and deodorizers. For example, prior art systems provide ventilation systems for toilets that have a ducted toilet seat. Inlet ports positioned around the inner rim of the seat remove odors in the air from in and around the toilet bowl. The odors are sucked through the ducted toilet seat through piping away from the toilet and out of the room to the outside environment exterior to the house. Also, there have been prior art attempts to ventilate and deodorize the toilet seat itself. In those prior systems, the toilet seat includes an odor collector comprising an impeller and a filter. The noxious odors are drawn into an inlet port and through the filter by the impeller thereby removing the odors from the air from inside the house to outside of the house.

Further systems in the prior art provide a ventilated commode comprising a ducted seat whose ducts lead to a hollow chamber which actively removes the captured odors and exhausts them into the wastewater drainage network. Such a system discloses a toilet-ventilating device comprising a ducted toilet seat whose ducts lead to a deodorizer. The deodorizer comprises an air-permeable cartridge containing an aromatic substance.

It should be noted that one disadvantage to the prior art devices discussed above is their complexity and relatively high costs associated with manufacture and deployment. Each of the above described devices requires a non-standard toilet or a non-standard toilet seat, thereby increasing the costs. In addition, some of the aforementioned devices require an internal power supply or connection to the home power system.

Attempts to overcome the aforementioned shortcomings have also been attempted. There are prior art devices that disclose a toilet bowl ventilation apparatus comprising an intake duct that either fits between the toilet seat in the closed position and the toilet bowl rim or is structurally integrated into the toilet bowl rim. In the first case, the intake duct is mounted on the side of the toilet bowl. Another prior art system discloses an exhaust head detachably mounted to the side of a toilet. The exhaust head is mounted to the toilet by magnets. Both of these devices, however, have their own drawbacks, including being inconveniently mounted on the side of the toilet, which creates an unsightly appearance and is likely to draw unwanted attention.

Despite the advantages of known ventilation systems and apparatuses for toilets, improvements are still being sought. For example, many of the previously available systems and apparatuses require expensive modifications to the toilets or seats. Even when modification of the toilet or toilet seat is not required, the resulting apparatus is inconveniently mounted on the side of the toilet where it can fall off or be removed by a child.

Attempts in the prior art to de-humidify a home are very similar to the above attempts to remove noxious odors from the home. Similarly, an exhaust is provided to pull air from a given room that is in need of dehumidification. Typically, these are independent ventilation systems that pull humid air into an intake for circulation to a dehumidification system for processing. Once water is removed from the air, it can be recirculated back into the room. Alternatively, the humid air can be simply sucked out of the home via an exhaust system into the outside environment.

Prior art device and systems thus suffer from many disadvantages that are addressed by the present invention. The present invention minimizes, and in some aspects eliminates, the above-mentioned failures, and other problems, by utilizing the methods and structural features described herein.

The features and advantages of the disclosure will be set forth in the description that follows, and in part will be apparent from the description, or may be learned by the practice of the disclosure without undue experimentation. The features and advantages of the disclosure may be realized and obtained by means of the instruments and combinations particularly pointed out in the appended claims.

In view of the foregoing, there is a need for a toilet and bathroom exhaust system that efficient removes odors and humidity from the area. There is a need for a toilet and bathroom exhaust system that is automatic that requires little or no user interaction. There is yet a further need for a toilet and bathroom exhaust system that is easy and inexpensive to install and use.

SUMMARY OF THE INVENTION

The present invention preserves the advantages of prior art toilet and bathroom exhaust systems. In addition, it provides new advantages not found in currently available toilet and bathroom exhaust systems and overcomes many disadvantages of such currently available toilet and bathroom exhaust systems.

To address the problems and shortcomings of the prior art, a toilet and bathroom exhaust system of the present invention provides a single system that handles both the removal of noxious odors in an around the toilet and dehumidification of the air in the entire room.

The present invention provides an exhaust system with an intake manifold located between the toilet seat lid and the toilet bowl where air is removed from the toilet area via a first air line by an exhaust fan so it may exit to either the outside environment outside the home. Alternatively, the air may be routed back into the toilet itself, such as in the internal trap area, such as below the waterline of the toilet (when not being flushed). The manifold may be affixed to the underside of the toilet seat or it may be fastened directly to the top of the toilet bowl, such as using the same fasteners that secure the toilet seat to the top of the toilet bowl. Thus, as in various embodiments, the collected noxious air may be routed outside the bathroom, outside the house entirely or it may be routed into the toilet both construction itself for complete removal from flushing of the toilet.

It is also possible for the system of the present invention to introduce fresh air from either outside the bathroom or outside the house into the intake manifold at the toilet seat so when noxious air is removed from the toilet seat, it is replaced with fresh air from outside the bathroom. Also provided is an intake vent and a second air line to pull air from the space of the room so that it may also be pulled out from inside the room to outside the house. This second air line is supplied into the line that supplies the fresh air into the toilet seat, which is, in turn, routed outside the house by the exhaust fan.

A damper valve and humidity sensor may also be employed where the damper valve will only open and permit ambient air from the room if the humidity level of that air exceeds a predetermined level.

Furthermore, a proximity sensor is provided that senses the presence of a person in the room to instruct the exhaust system of the present invention to turn on thereby saving energy costs when the system is not needed.

BRIEF DESCRIPTION OF THE DRAWING FIGURES

The novel features which are characteristic of the present invention are set forth in the appended claims. However, the invention's preferred embodiments, together with further objects and attendant advantages, will be best understood by reference to the following detailed description taken in connection with the accompanying drawings in which:

DESCRIPTION OF THE INVENTION

The present invention includes a number of embodiments. Also, dehumidification is integrated into the system of the present invention.

Figure 1:
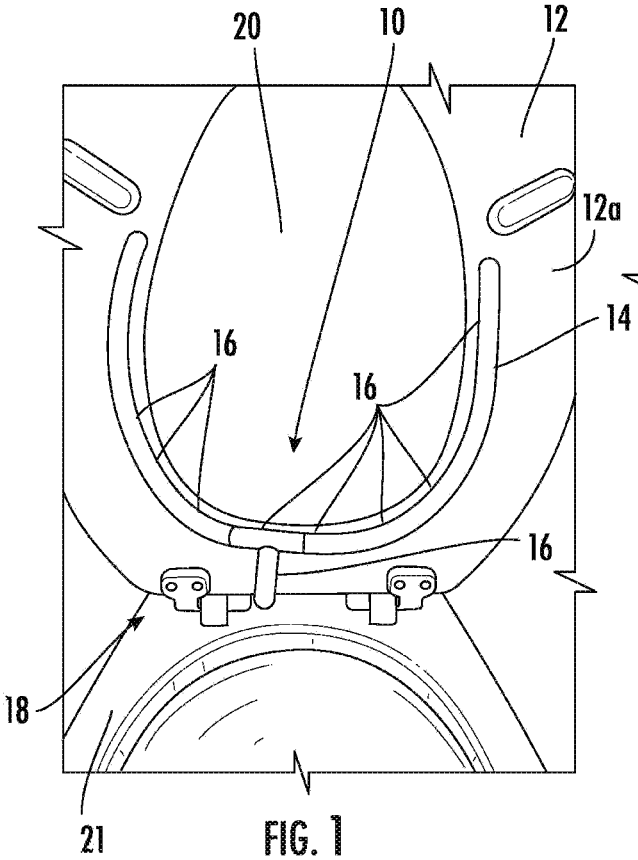
FIG. 1 shows a front view of a first embodiment of the present invention, with the toilet seat open, where a manifold is secured to the underside of a toilet seat and noxious air is removed via an exit tube to a remote location.

Turning first to FIGS. 1-5, a first embodiment 10 of the toilet and bathroom exhaust system is shown in detail. Turning first to FIG. 1, a front view of a first embodiment of the present invention 10, with the toilet seat 12 open, where a manifold 14 is secured to the underside of a toilet seat 12 and noxious air is removed via an exit tube 16 to a remote location. More specifically, the manifold 14 may include a perforated tube or a tube with an array of holes 16 therethrough is adhered to the bottom 12*a* of the toilet seat 12. It can be glued or otherwise secured to the bottom 12*a* of the toilet seat 12. The perforated tube acts as a manifold 14 with multiple inlet ports 16 to pull (noxious) air located in the area of toilet, generally referred to as 18. As can be understood, when the toilet lid 20 is closed and resting on the top of the toilet seat 12, the tubular manifold 14 is particularly close to the noxious air and is, therefore, well-positioned to remove such noxious air. While the manifold 14 is shown as a flexible tubular configuration, it can be of other configurations, such as of a rigid molded configuration, or the like.

Figure 4:
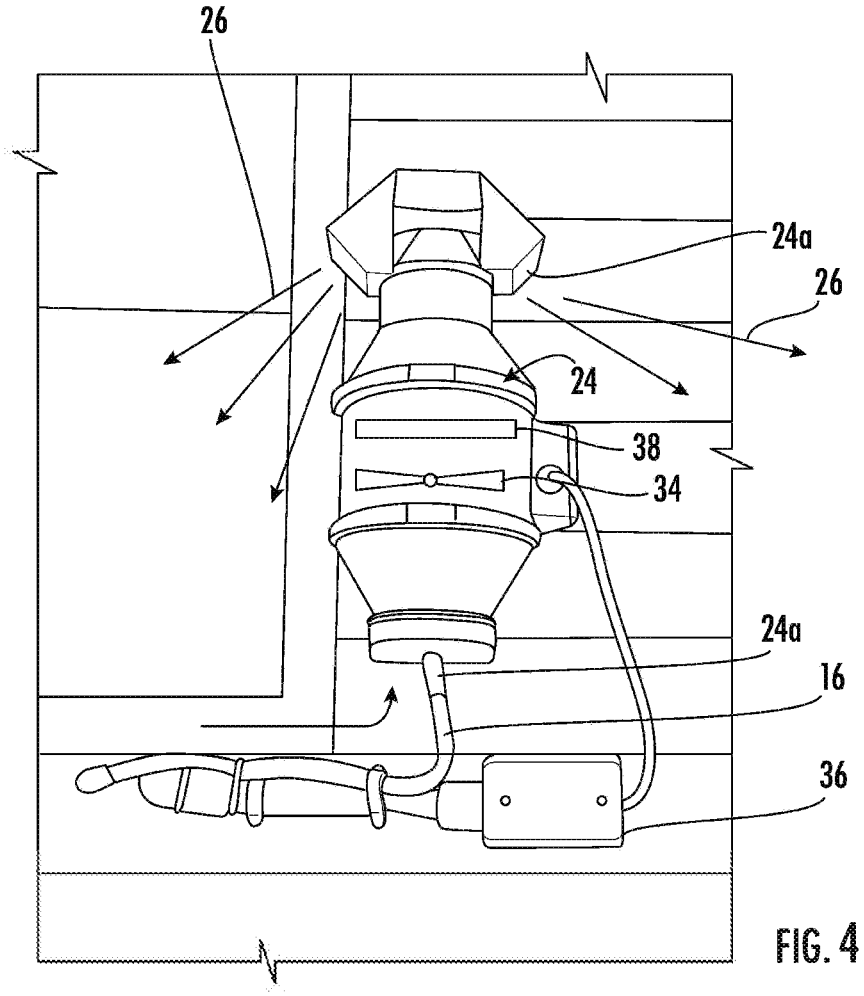
FIG. 4 is a side view of the exhaust fan unit mounted to the exterior of a house for routing of noxious air completely outside of the house.
Figure 5:
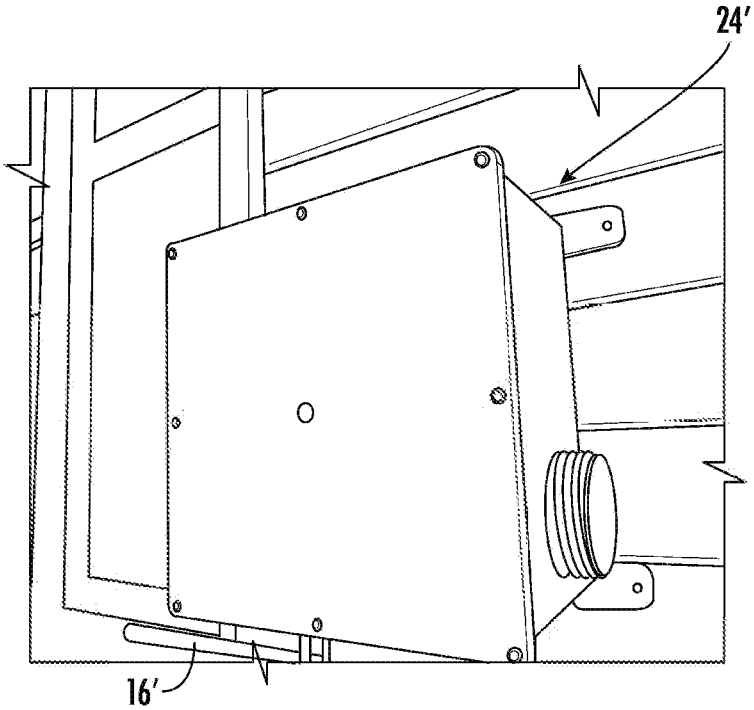
FIG. 5 is an alternative location and configuration of an exhaust fan unit mounted on the exterior of a house.
Figure 26:
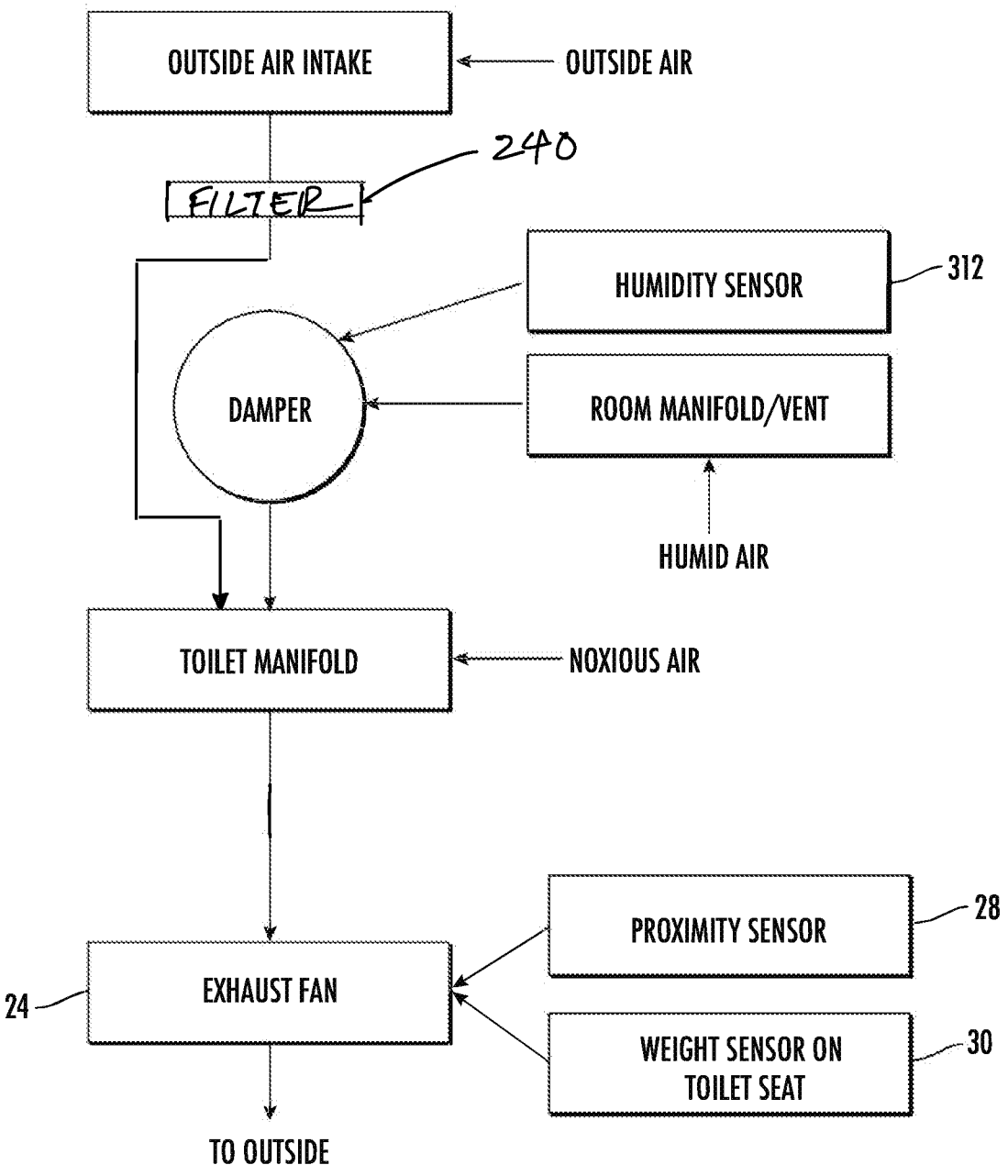
FIG. 26 is a flow chart showing the direction of humid air to the exhaust fan and filter unit if humidity is sensed over a predetermined level.

In general, the invention is shown to include an arcuate intake manifold 14 that is affixed to the bottom 12*a* of the toilet seat 12 that faces the bowl 20 (not the toilet lid). The manifold 14 is connected to a tube 16 that exits the house 22 and is connected an exhaust fan 24. The exhaust fan and filter unit 24, as shown in FIGS. 4 and 5, pulls noxious air 26 from the toilet area out of the house 22 and through the exit vent 24*a* of the exhaust fan 24. A proximity sensor 28 (as shown in FIG. 26) can also be provided that senses a person on the toilet 18 or in the room 22. When a person is sensed on or near the toilet 18 or in the room 22, the exhaust fan 24 will turn on and can remain on until the person leaves the area. Also, a weight sensor 30 can be integrated into the seat 12 for the same purpose. The use of such a sensor 28 or 30 saves energy in that the system will operate only when needed, that is, when there is a person on the toilet 18 or in the room 22.

Figure 2:
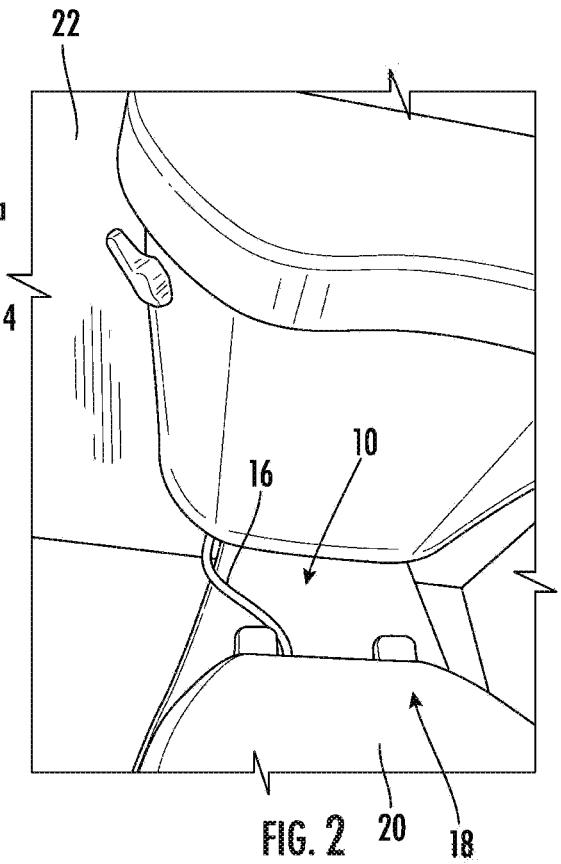
FIG. 2 is a front view of the invention of FIG. 1 where is toilet seat is closed.
Figure 20:
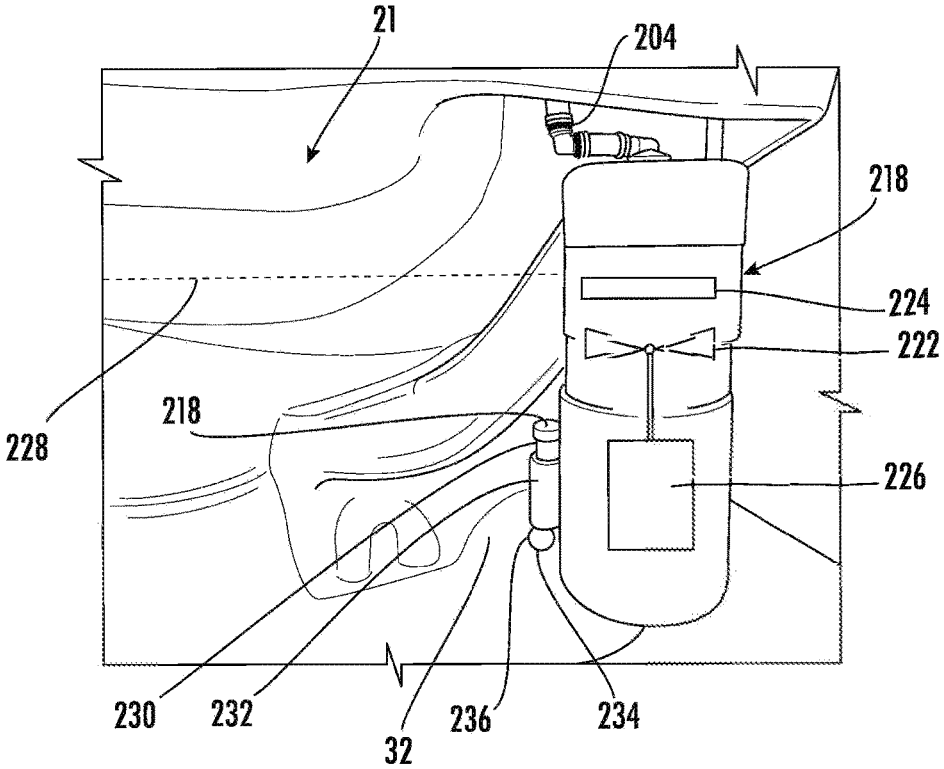
FIG. 20 is a side view of the exhaust fan and filter unit attached to the toilet for receiving noxious air from the manifold and routing it into the trap of the toilet.

In FIG. 2, a front view of the invention of FIG. 1 with the toilet seat 12 closed is shown. The exit or outbound tube 16 pulls noxious air from the toilet area and routes it to another location, which may be outside the bathroom 22, outside of the house entirely or into the trap area 32 of the toilet, such as seen in FIG. 20 and discussed in detail below.

Figure 3:
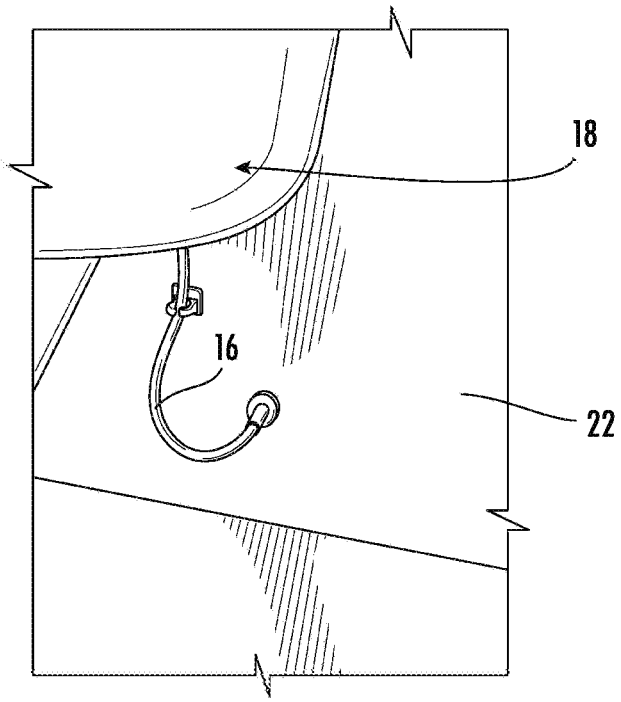
FIG. 3 is a perspective view showing the routing of the exit hose being routed outside the bathroom to a remote location.

FIG. 3 is a close-up perspective view showing the routing of the exit tube 16 outside the bathroom 22 to a remote location, such as outside the bathroom 22 or outside of the house entirely, as shown in FIGS. 4 and 5 below.

FIG. 4 is a side view of the exhaust fan and filter unit 24 mounted to the exterior of a house 22 for routing of noxious air completely outside of the house 22. The exit tube 16 can be seen exiting the house 22 through an exterior wall and then directed into the inlet port 24*a* of the exhaust fan and filter unit 24. The exhaust fan and filter unit 24 is of a construction that is well known in the art and may be modified to suit the application at hand. For example, it may be many different configurations, such as in FIG. 5, where fan/impeller 34 is powered, such as by a 120 volt power supply 36, to pull air through the exit tube 16 and through the exhaust fan and filter unit 24. A filter 38 is preferably provided in line with the fan 34 within the exhaust fan and filter unit 24. The filter 38 may or may not be replaceable. Thus, as seen in FIG. 4, noxious air 26 may freely flow out of the air and filter unit 24 into the environmental outside air. FIG. 5 shows an alternate configuration of an exhaust fan and filter unit 24' with supply line 16'.

Figure 6:
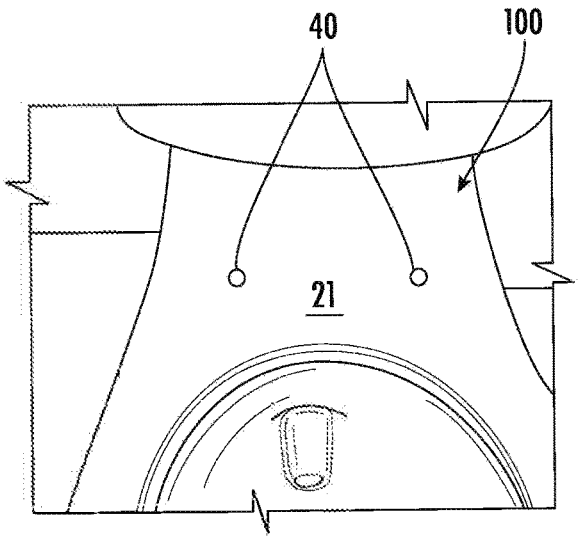
FIG. 6 is a from perspective view of a toilet bowl with the through-holes for securing a toilet seat thereto for use in connection with a second embodiment of the present invention.

Turning now to FIGS. 6-11, a second embodiment 100 of the present invention is shown. First, FIG. 6 shows a known prior art toilet bowl 20 which has a number, typically two, through-holes 40 for receiving bolts therethrough for securing the toilet seat 12 and lid assembly 24 to the toilet 20.

Figure 7:
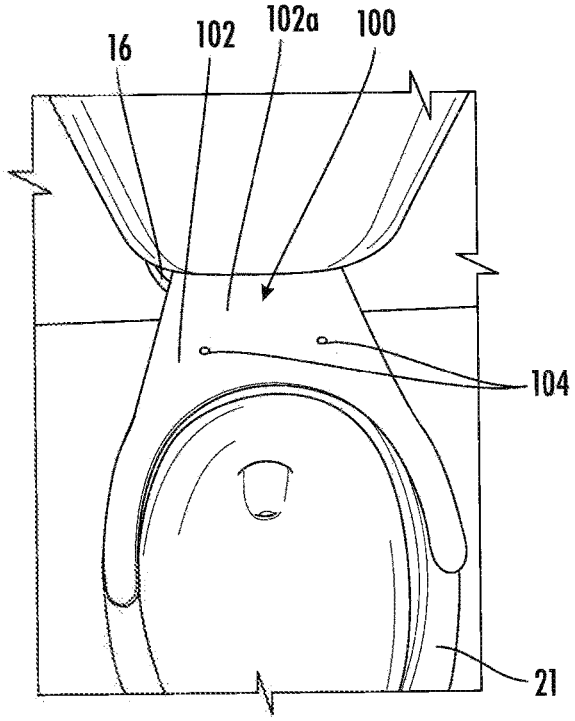
FIG. 7 is a front perspective view of the toilet bowl and manifold in accordance with the second embodiment of the present invention.
Figure 8:
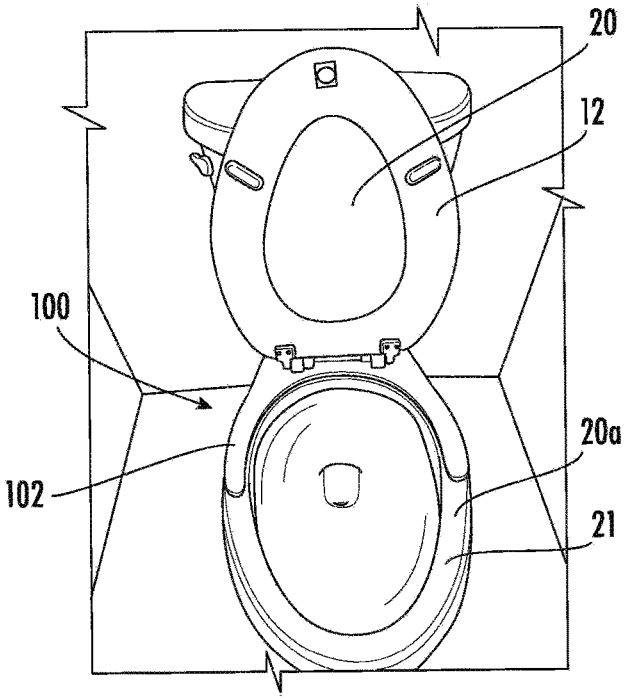
FIG. 8 is a front perspective view of a toilet seat secured to the toilet bowl with manifold sandwiched therebetween in accordance with the second embodiment of the present invention.

In FIG. 7 of this second embodiment 100, instead of the manifold 102 being positioned underneath the seat 12 as in FIG. 1, it is mounted directly on the top 20*a* of the bowl 20 where its arcuate shape aligns with the bowl 20. The shape and configuration of the manifold 102 in the second embodiment may be modified to the suit the application at hand as well as the shape and size of the toilet 20.

Figure 9:
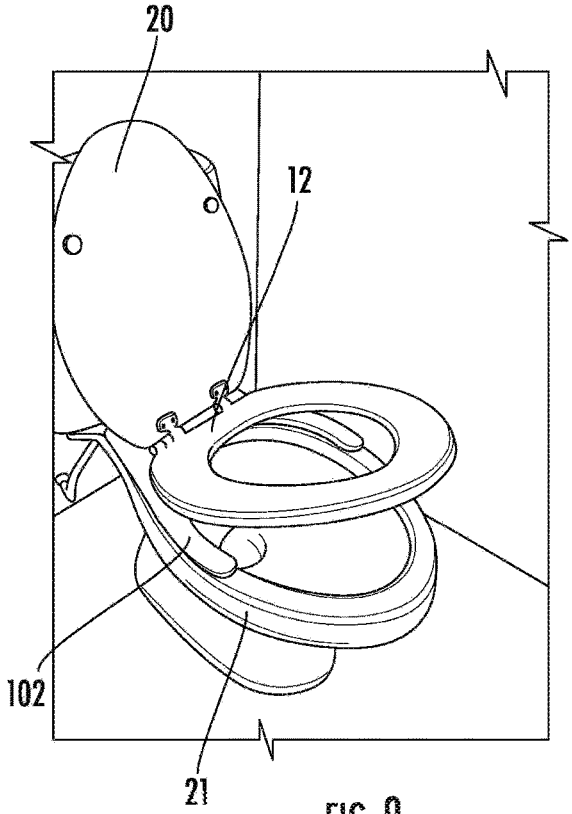
FIG. 9 is a front perspective view of the second embodiment of the present invention with the toilet seat in the process of being closed.
Figure 10:
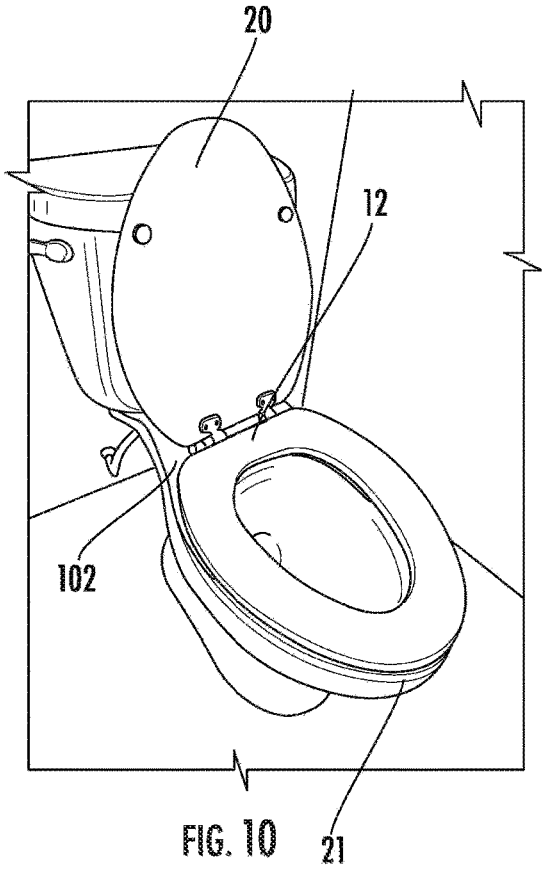
FIG. 10 is front perspective view of the second embodiment of the present invention with the toilet seat fully closed.
Figure 11:
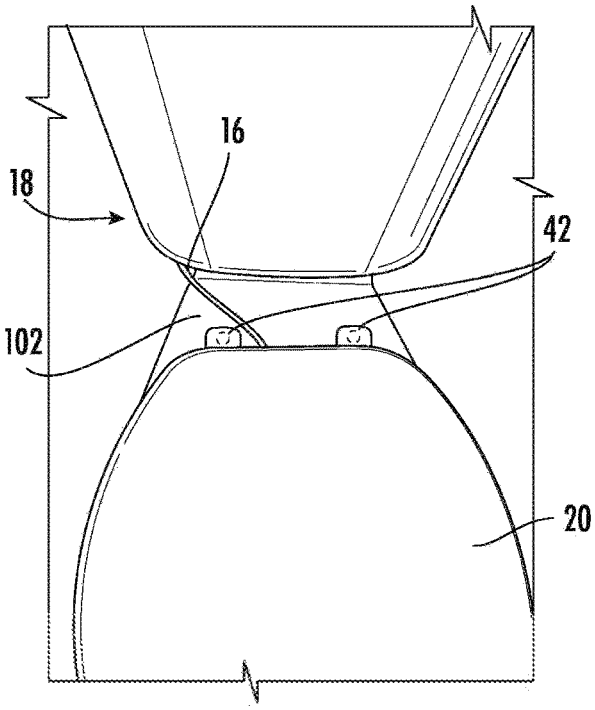
FIG. 11 is a top view of the second embodiment of the present invention with the toilet seat closed.

A rear region 102*a* is provided with holes therethrough to receive the bolts 42 for the seat and lid assembly 12, 20. This second embodiment 100 of the intake manifold 102 has a plan shape that is very close to the top of the bowl 20 helps hide the fact that there is a manifold 102 sitting between the top 20*a* of the bowl 20 and the toilet seat 12. Still referring to FIG. 7, the exit tube 16 is connected much further rearward thereby hiding it better making for a more aesthetically pleasing installation. Also, the manifold 102 includes through-holes 104 that align with the standard bolt holes 40 through the toilet bowl 20. Thus, the seat and lid assembly 12, 20 and the second embodiment of the manifold 102 of the present invention in FIGS. 6-11 are secured to the toilet bowl 21 by the same bolts 40, as in FIG. 8. As shown in FIGS. 9-11, the seat 12 and lid 20 operate normally even with the second embodiment of the intake manifold 102 installed. Namely, in FIG. 9, the seat can freely move from an upper open position toward a lowered position, as shown in FIG. 10. Moreover, as in FIG. 11, the lid 20 can be completely closed in the same fashion as a toilet seat 12 and lid 20 arrangement on a toilet 21 not equipped with the exhaust system 100 of the present invention.

The exit tube 16 from the embodiment of the manifold 102 of the present invention of FIGS. 6-11 can be routed outside the bathroom 22, outside the house or into the trap portion 32 of the toilet 21, as will be discussed in detail below.

Figure 12:
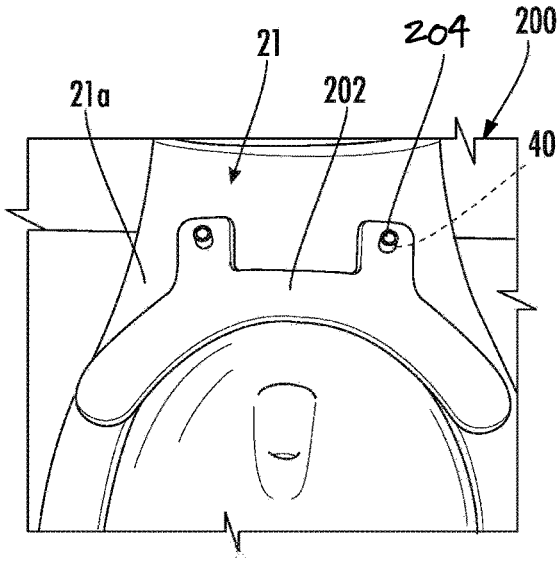
FIG. 12 is a front perspective view of a third embodiment of the present invention with the manifold positioned on the top of the toilet bowl and configured to direct noxious air through a hollow fastener located in one of the through-holes for securing a toilet seat thereto.

Further, a third embodiment 200 of the present invention is shown in FIGS. 12-21. The manifold 202 of the third embodiment is shown in FIG. 12 where the manifold 102 is a separate unit and is positioned on the top 21*a* of the toilet bowl 21. Unlike the embodiment of FIGS. 7-11, the third embodiment 200 is configured to direct noxious air from the outlet 202*a* of the manifold 202 downwardly through a hollow fastener 204 located in one of the through-holes 40 for securing a toilet seat 12 and lid 20 thereto. Thus, the hollow fastener 204 both routes noxious air for removal and also mechanically secures the toilet seat 12 and lid 20 assembly to the toilet bowl 21.

Figure 13:
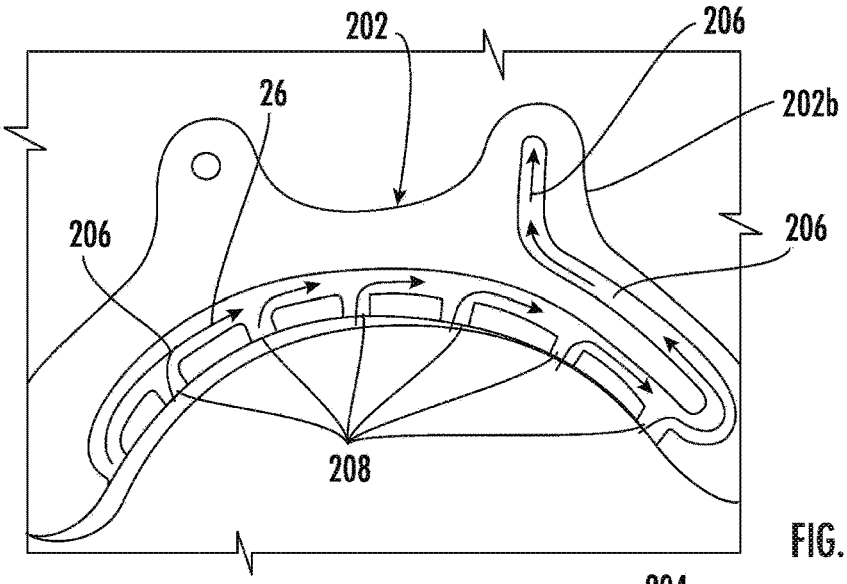
FIG. 13 is a first portion of the manifold used in connection with the third embodiment of the present invention.
Figure 14:
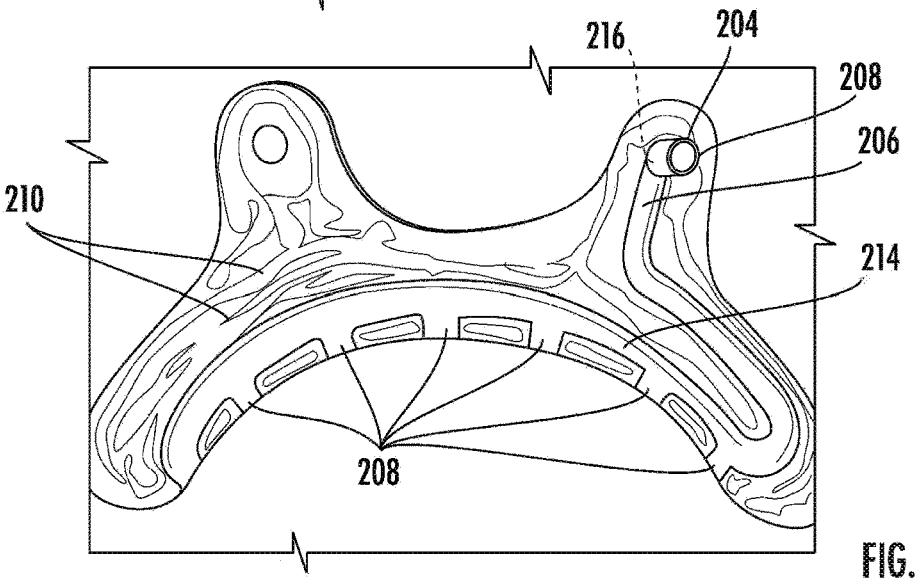
FIG. 14 is the first portion of the manifold of FIG. 13 prepared with glue, an exit tube and threaded through-hole fastener.
Figure 15:
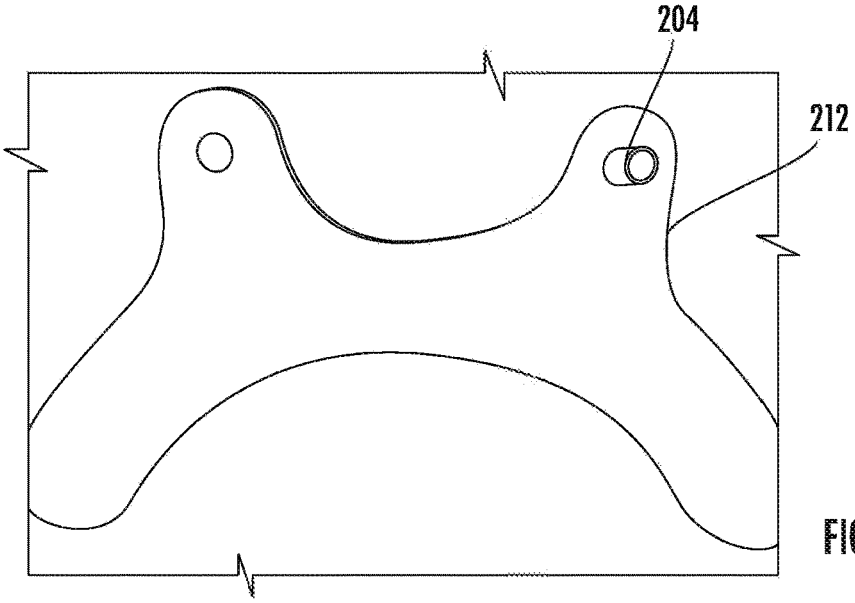
FIG. 15 shows a cover to be glued to the first portion of the manifold of FIG. 14 to provide the completed manifold construction of FIG. 12.

Details of the construction of the manifold 202 of the third embodiment 200 of the present invention is shown in FIGS. 13-15. FIG. 13 shows a first portion 202*b* of the manifold 202 used in connection with the third embodiment 200 of the present invention where a number of internal air lines 26 are provided within the first portion 202*b*. Air 26 is pulled in through the inlet ports 208 and then routed toward one of the holes 208 of the manifold 202 that aligns with one of the through-holes 40 in the toilet bowl. FIG. 14 shows the manifold portion of FIG. 13 with glue 210 thereon to receive the manifold cover 212, as shown in FIG. 15. In FIG. 14, a short exit tube member 214 is provided at the juncture between the internal air lines 26 of the manifold 202 and a threaded hollow fastener 204. The short exit tube 214 is located in a side wall hole 216 in the hollow fastener 204 so that air may flow from the internal air lines 26 in the manifold 202, through the short exit tube 214 and down through the internal space defined by the hollow fastener 204. Thus, when the cover 212 of FIG. 15 is secured to the manifold portion 202*b* of FIG. 14, a manifold unit 202*b*, 212 provides a noxious air removal route that extends from the a number of air inlet apertures 208 that face toward the open bowl 21 to through one of the hollow fasteners 204 for further processing by the exhaust fan and filter unit 24.

Figure 16:
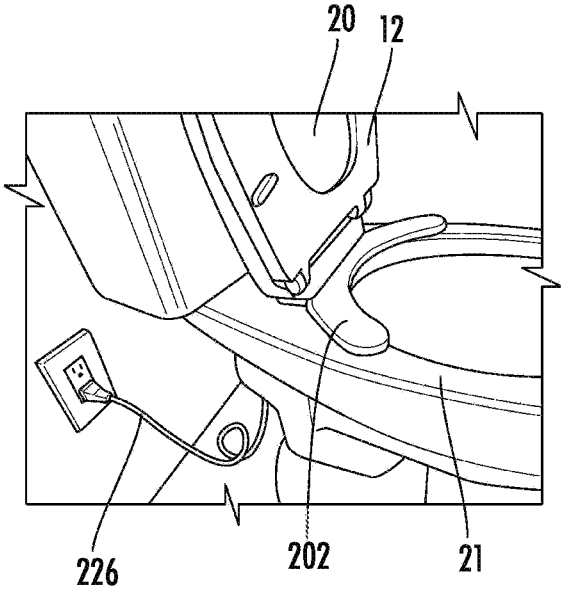
FIG. 16 shows the manifold of the third embodiment of FIG. 12 sandwiched between the toilet seat assembly and the toilet bowl.
Figure 17:
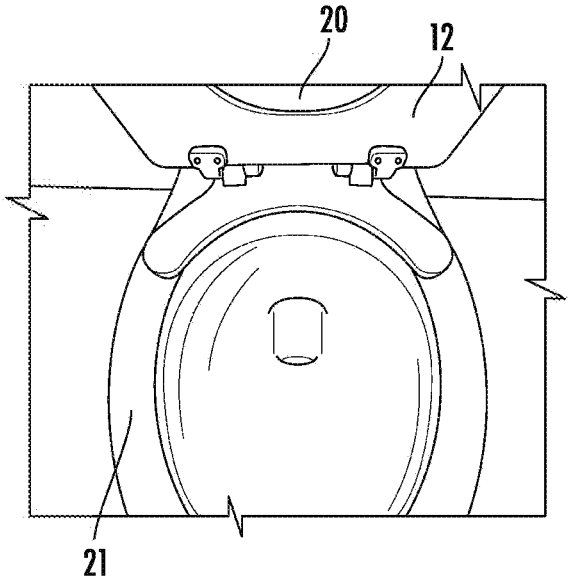
FIG. 17 shows a front perspective view of the invention of FIG. 16.
Figure 18:
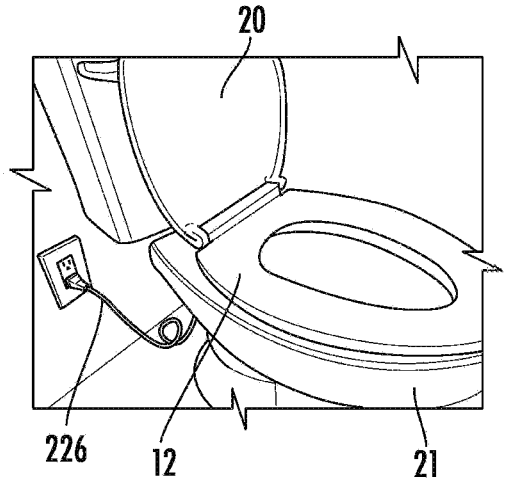
FIG. 18 is a perspective view of the manifold of the third embodiment of FIG. 16 with the toilet seat down.
Figure 19:
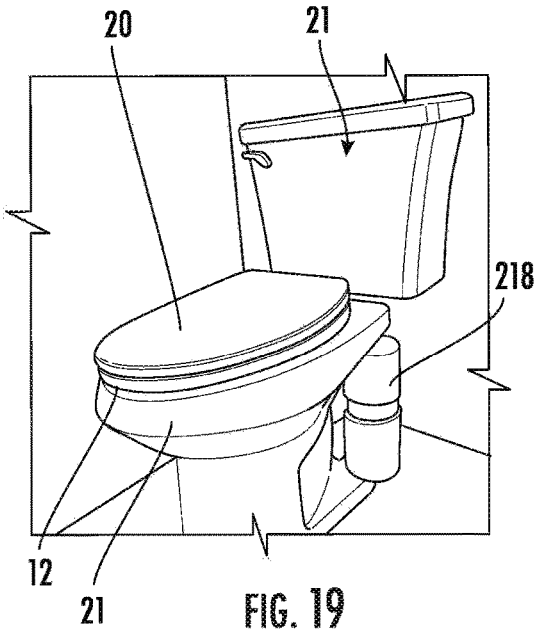
FIG. 19 is a perspective view of the manifold of the third embodiment of FIG. 16 with the toilet lid closed.

Once installed, as in FIGS. 16-18, the manifold of the third embodiment 200 of FIG. 12 is sandwiched between the toilet seat assembly 12, 20 and the toilet bowl 21. FIG. 17 shows a front perspective view of the manifold 202 of FIG. 16 with the toilet seat 12 and lid 20 completely open with the manifold 202 secured in place by the fasteners 204 used to secure the seat 12 and lid 20 to the toilet bowl 21. As shown in FIGS. 18 and 19, it can be seen that the manifold 202 of the third embodiment 200 is virtually completely hidden underneath the seat and lid assembly 12, 20, particularly because the exit path for the air 26 from the manifold 202 is now internal within one of the hollow fasteners 204.

In this third embodiment 200, the exit of the manifold 202 is preferably not routed outside the bathroom 22 or outside the entirety of the house but, instead, the collected noxious air is routed into the trap region 32 of the toilet 21, as seen in FIG. 20. FIG. 20 shows the exhaust fan and filter unit 24 mounted to the side or underneath the toilet bowl 21. The lower open end 204*a* of the hollow fastener 204, via connector tubes 206, to the inlet port 220 of the fan and filter unit 218. Therefore, since the air directed internally within a hidden hollow fastener 204, additional external tubes 16 are avoided to provide a very clean and aesthetically appealing installation. Also, since the exhaust fan and filter assembly 218 are locally positioned next to (underneath) the toilet 21, installation is less complicated than routing a long exit tube 16 outside the bathroom 22 to another room or outside the house entirely.

Figure 21:
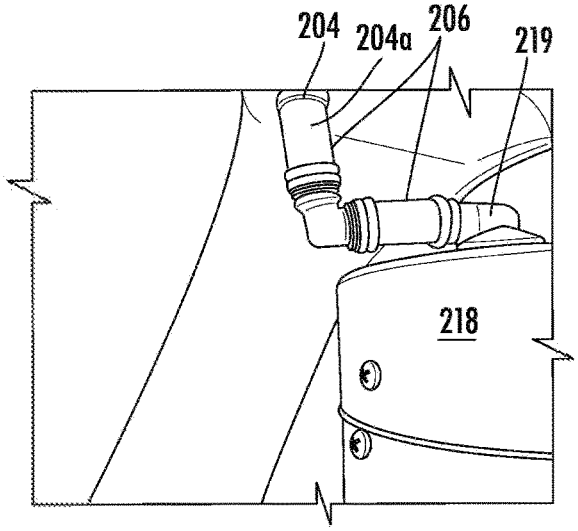
FIG. 21 is a close-up view of the tube supplying noxious air from the manifold to the inlet of the exhaust fan and filter unit of the third embodiment of the manifold of FIG. 12.

Still referring to FIG. 20, the exhaust fan and filter unit 218 may be made in many different ways and still be within the scope of the present invention. Inside therein, a fan 222 with filter 224 is provided that is powered by a 120 volt power supply, such as via power cord 226, as shown in FIGS. 16 and 18. As is well-known in the prior art, an exhaust fan 222 is powered by a motor 226 to rotate the fan 222 at a desired speed. The fan 222, filter 224 and motor 226 are representationally shown in FIG. 20. As a result, noxious air is pulled downwardly into the exhaust fan and filter unit 218 and then routed through an exit port 218*b* for further direction to the interior of the toilet bowl in the trap area 32 below the waterline 228, for example. A port fitting 230 and tube 232 is preferably provided at the exit of the exhaust fan and filter unit 218 for interconnection to a toilet port 234 via a toilet port fitting 236. FIG. 21 shows a close-up view of the tubes 206 connected to the hollow fastener 204 for supplying noxious air from the manifold to the inlet 219 of the exhaust fan and filter unit 218 of the third embodiment 200 of the manifold of FIG. 12. Various other fittings and tubes may be used to fluidly route the noxious air to the inlet of the exhaust fan and filter unit 218.

Figure 22:
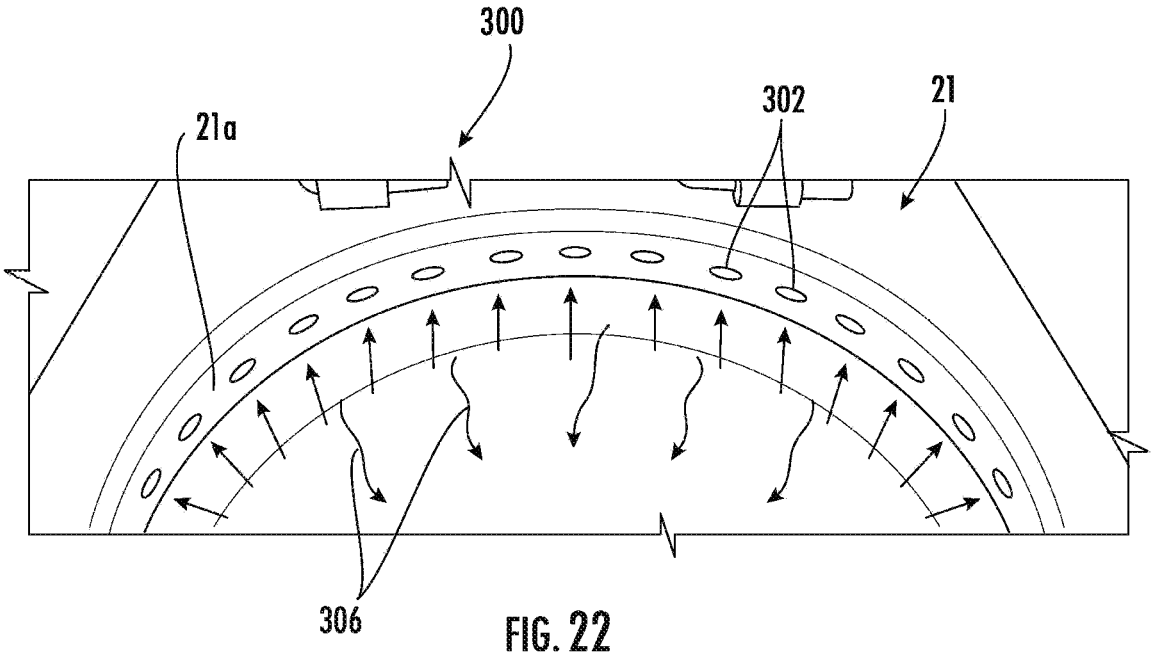
FIG. 22 is a front perspective view of the toilet with an integrated manifold of a fourth embodiment of the present invention.
Figure 23:
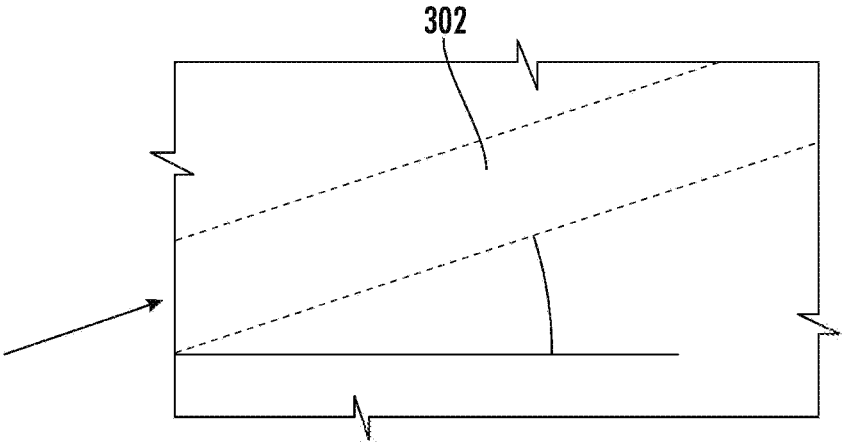
FIG. 23 is as cross-sectional view of the toilet bowl rim with angled air inlet ports of the integrated manifold.

Turning now to FIGS. 22-25, a fourth embodiment 300 of the system of the present invention is shown. In FIG. 22, an overview of the fourth embodiment 300 is shown to include a finished toilet 21 where the air intake manifold with exhaust holes 302 and the water supply/drainage holes 304 are integrated directly into the rim 21*a* of the toilet 21. The air intake pulls noxious air from the toilet bowl area while the water drainage and supply are shown at 306 to deliver the usual water 306 into the bowl 21 for refilling it after a flush. FIG. 23 shows a cross-sectional view of the rim of the toilet bowl 21 where it the integrated air intake manifold holes 302 are preferably angled upwardly to facilitate the removal of air from the area and delivery through a tube to the exhaust fan and filter that resides exterior to the toilet bowl 21.

Figure 24:
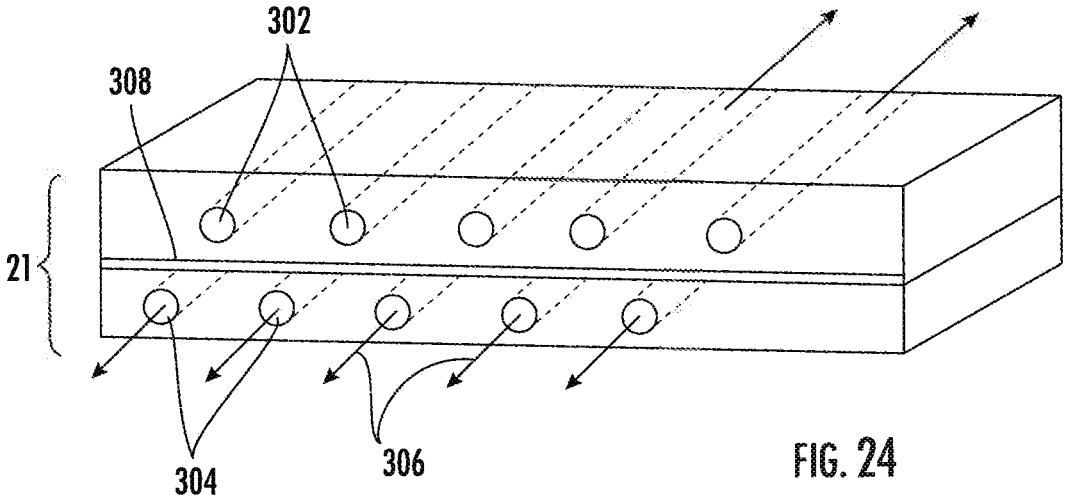
FIG. 24 is a perspective cross-sectional view through the rim of the toilet bowl with ports to remove noxious air and ports to route flush water into the bowl.
Figure 25:
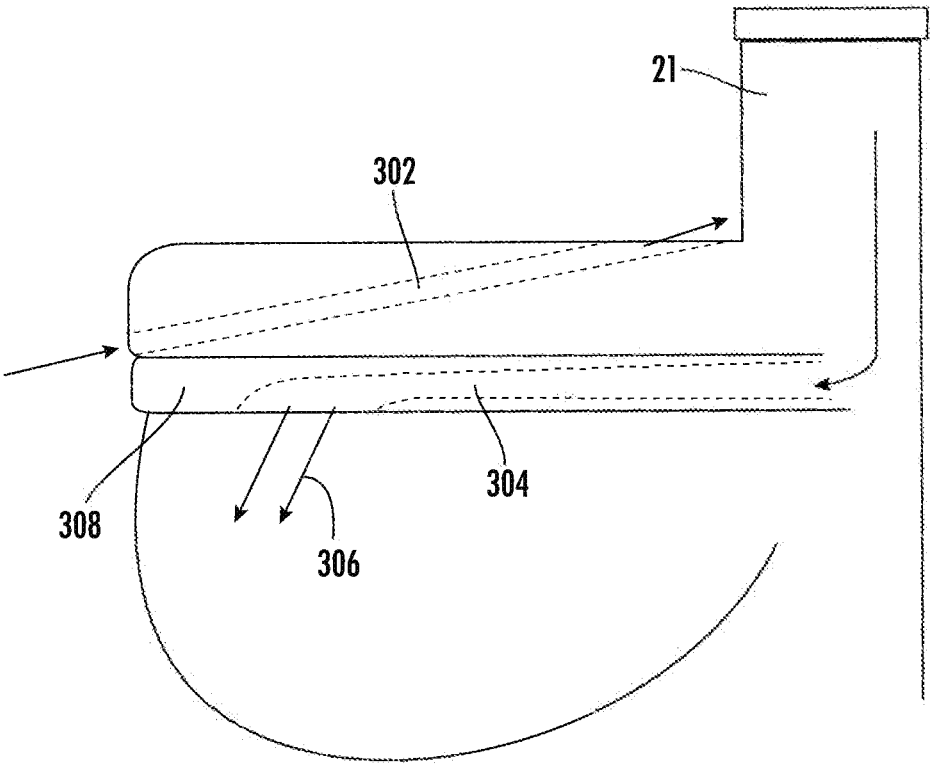
FIG. 25 is a side cross-sectional view of the embodiment of FIGS. 24.

FIGS. 24 and 25 show further details of the fourth embodiment 300 of the present invention. In FIG. 24, a partial cross-sectional view is shown whereby a separating partition 308 is provided to isolate the air intake holes 302 for removing noxious air from the water supply/drainage holes 304 that deliver water 306 for flushing. FIG. 25 shows a cross-section of the toilet bowl 21 to illustrate how the air exhaust manifold and the water drainage lines are integrated into the rim of the toilet 21 with a separating partition 308 disposed therebetween.

Thus, the fourth embodiment 300 of the present invention provides yet a further alternative configuration to carry out the present invention. In this fourth embodiment 300, the fully integrated solution is ideal for a new custom toilet construction and installation. On the other hand, the first 10, second 100 and third embodiment 200 of the present invention, as discussed in detail above, are solutions where the exhaust manifold and air removal system is retrofitted to an existing toilet installation. Therefore, the exhaust system of the present invention provides multiple configurations to suit the given installation needs and at hand.

In operation, as seen in FIG. 26, a sensor 30, 28 senses that someone is on the toilet or in the room, which turns on the exhaust fan and filter unit 24. The fan pulls air from the toilet area inside the house, namely in the bowl area, through the intake manifold (whether retrofitted on the toilet bowl or sear or integrated into the bowl, through the tube and then out to and area outside of the bathroom, outside of the house entirely or via a through-hole, to an exhaust fan and filter unit. This effectively removes noxious air. The invention can be easily installed and retrofitted to existing toilets. A timer (not show) can optionally be provided that keeps the exhaust system on even after the person has left the bathroom for additional odor removal and dehumidification.

It should also be noted that any of the vents or manifolds, particularly, the intake vent for the exhaust fan and filter unit may be equipped with a filter 240, such as a UV, ionic, filter media or other type of filter to improve the quality of incoming air. It is further possible that just a fan is provided in the exhaust fan unit.

Also, still referring to FIG. 26, the exhaust system can also pull air from the environment of the room when a humidity sensor 312 determines that the level of humidity has exceeded a predetermined amount. If sufficient humidity is sensed, a damper is opened to permit the exhaust system of the present invention to also pull air from the room environment and remove it from the room and route it outside the house along with the noxious air from around the toilet seat. A schematic overview of the operation of the system and method of the improved toilet and bathroom exhaust system of the present invention is shown if FIG. 26. The toilet exhaust and room dehumidification exhaust system are integrated into a single system.

Different embodiments of the manifold are provided. The invention herein provides for routing of noxious air to different locations, such as outside the bathroom to another room or area of the house, outside of the house entirely or into the toilet itself, such as into the dry trap area of the toilet. It should be understood that the different manifold types and configurations may be mixed and matched with the different outlet configurations and still be within the scope of the present invention.

It would be appreciated by those skilled in the art that various changes and modifications can be made to the illustrated embodiments without departing from the spirit of the present invention. All such modifications and changes are intended to be covered by the appended claims.

What is claimed is:

1. A toilet and bathroom exhaust system, comprising:

a manifold having first portion and manifold cover and a plurality of inlet ports and an exit port; the plurality of inlet ports being in fluid communication with the exit port and arranged in an inlet port arcuate configuration in the first portion; the inlet ports being in fluid communication with an arcuate air passageway, having two opposing ends, in the first portion; the manifold cover residing over and adhered to the first portion thereby defining the inlet ports and the arcuate air passageway residing therebetween; the manifold being configured and arranged to rest on a top surface of a toilet bowl of a toilet having at least one seat fastener holes therethrough;

the arcuate air passageway being substantially parallel to the inlet port arcuate configuration;

a connector tube connected to the second end of the arcuate air passageway and partially doubling back in arcuate and parallel fashion with the arcuate air passageway; the connector tube residing between the first portion and the manifold cover;

an exhaust fan unit having an inlet end and an outlet end;

a first hollow fastener, having a first end and a second end, being configured and arranged to be routed through one of the at least one seat fastener holes; the exit port being in fluid communication with an interior passageway of the first hollow fastener; the connector tube fluidly connecting the arcuate air passageway with the interior passageway of the first hollow fastener;

the interior passageway of the first hollow fastener being in fluid communication with the exit port of the manifold and the inlet end of the exhaust fan;

the manifold being configured and arranged to reside between the top surface of the toilet bowl and a toilet seat secured to the toilet bowl via the first hollow fastener;

whereby air is routed from the at least one inlet port of the manifold, through the arcuate air passageway, then through the connector tube, then into the first hollow fastener and then into the exhaust fan for removal of the air from the toilet manifold.

2. The toilet and bathroom exhaust system of claim 1, wherein the first hollow fastener is configured and arranged to secure a toilet seat and the manifold to a top surface of a toilet bowl.

3. The toilet and bathroom exhaust system of claim 1, wherein the exhaust fan is located exterior to a bathroom; a fluid line extending between the second end of the first hollow fastener and the inlet end of the fan thereby removing noxious air from the bathroom.

4. The toilet and bathroom exhaust system of claim 1, wherein the exhaust fan is located exterior to a house in which the bathroom is located.

5. The toilet and bathroom exhaust system of claim 1, further comprising:

a proximity sensor configured and arranged to detect presence of a person in the bathroom;

whereby when a person is sensed in the room, the exhaust fan is turned on.

6. The toilet and bathroom exhaust system of claim 1, further comprising an inlet port to an internal trap inside a toilet; the outlet of the exhaust fan being in fluid communication with the internal trap inside the toilet; whereby noxious air is routed from an area of the toilet to inside the internal trap inside the toilet.

7. The toilet and bathroom exhaust system of claim 1, wherein the exhaust fan is configured and arranged to be mounted to a toilet.

8. The toilet and bathroom exhaust system of claim 1, further comprising:

a filter located in line with the exhaust fan.

* * * * *